United States Patent [19]

Sogge et al.

[11] Patent Number: 5,004,876

[45] Date of Patent: Apr. 2, 1991

[54] PRESSURE RESPONSIVE SWITCH PARTICULARLY ADAPTABLE FOR OPERATION AS A NORMALLY OPEN OR A NORMALLY CLOSED SWITCH

[75] Inventors: Dale R. Sogge, Randolph, Mass.; Edward F. O'Brien, Providence; David A. Czarn, Cumberland, both of R.I.

[73] Assignee: Texas Instruments Incorporated, Dallas, Tex.

[21] Appl. No.: 286,726

[22] Filed: Dec. 20, 1988

[51] Int. Cl.[5] ..... H01H 35/34

[52] U.S. Cl. ..... 200/83 P; 200/83 N; 200/292

[58] Field of Search ..... 307/118; 340/626; 200/292, 302.1, 303, 81 R, 83 R, 83 N, 83 P, 83 Q, 83 W, 83 J; 73/861, 47, 717, 723

[56] References Cited

U.S. PATENT DOCUMENTS

| | | | |
|---|---|---|---|
| 4,386,247 | 5/1983 | Couat | 200/83 N |
| 4,581,509 | 4/1986 | Sanford | 200/83 P |
| 4,794,214 | 12/1988 | Sanford | 200/83 P |

*Primary Examiner*—Gerald P. Tolin

*Attorney, Agent, or Firm*—John A. Haug; James P. McAndrews; Melvin Sharp

[57] ABSTRACT

A pressure responsive switch having upper and lower contact assemblies with a snap acting member and an electrically conductive member sandwiched therebetween. The assemblies each include an insulating body with a hollow center and an electrically conductive member having a contact in the center portion and extending externally of the body. The snap acting member is in constant engagement with the sandwiched conductive member and normally in engagement with the electrically conductive member of the upper assembly. When a pressure is applied which is sufficient to cause the snap acting member to snap into its second stable state, the connection thereof with the electrically conductive member in the upper contact assembly is broken and connection is made with the electrically conductive member in the lower assembly. The switch is normally closed by removing the portion of the electrically conductive member in the lower assembly which extends externally thereof. The switch can be provided normally open by removing the portion of the electrically conductive member in the upper assembly which extends externally thereof. In another embodiment, the switch is provided in conjunction with a printed circuit board. The switch comprises an electrically conductive contact member fixed to the board and having a contact bump and an air conducting passageway. An electrically conductive support for a flexible conductive member is secured to the board within the fixed conductive contact member, the flexible member moving into and out of engagement with the bump.

14 Claims, 6 Drawing Sheets

PRESSURE RESPONSIVE SWITCH PARTICULARLY ADAPTABLE FOR OPERATION AS A NORMALLY OPEN OR A NORMALLY CLOSED SWITCH

BACKGROUND OF THE INVENTION

1. Field of the Invention

This invention relates to a pressure switch and, more specifically, to a pressure responsive switch for mounting on a printed wiring board which is capable of operating in either the normally open or normally closed condition.

2. Brief Description of the Prior Art

It is relatively standard in the automotive art to control various functions by means of microprocessor based control units to obtain performance improvements.

One such application has included the operation of the transmission system by integrating engine and transmission control. Such operation requires that the transmission control be compatible with the engine control module (ECM) and be electronically accessible with inputs and outputs. One such prior art approach has utilized solenoid valves to effect gear shifting using pressure switches in the solenoid valve assembly as a way to confirm that solenoid valve actuation and deactuation has occurred responsive to pressure change in the hydraulic fluid. This pressure change is sensed using conventional snap acting pressure responsive switches which close or open electrical circuits on the occurrence of selected pressure levels. A problem with switches of this type is that snap acting switches have a lower life expectancy than is desired.

In Ser. No. 06/903,328, filed Sept. 3, 1986, there is disclosed an attempt to minimize this problem wherein a control system is provided where a metallic diaphragm is used having significantly improved longevity. Such diaphragms are formed with a central dished portion having a pressure deflection relationship such that the diaphragm is relatively stiff, having a positive coefficient of pressure with increasing deflection up to and above a relatively narrow range of set points or calibrated pressures. Within the range of set points the effective spring rate of the diaphragm is relatively supple with only a small increase in pressure resulting in relatively larger travel of the center of the diaphragm. The diaphragms are also characterized in having significantly less hysteresis than conventional snap acting discs to minimize the build up of stresses in the diaphragm since these stresses serve to limit the longevity of the diaphragm. Among the embodiments disclosed are switches in which the diaphragms are formed with an annular flat berm portion which is received on an electrical contact member with an "O"-ring disposed on top of the berm and biased thereagainst to form a fluid pressure seal by a tubular sleeve which communicates with an hydraulic fluid pressure source. Another embodiment provides a sleeve formed in two segments with the "O"-ring sandwiched therebetween so that the sleeve itself engages the berm portion.

An electrical contact rivet is placed beneath the central dished portion and connected to a suitable electrical connector. While the berm provides a convenient way to mount and seal the diaphragm, the integral interconnection between the flat berm portion and the central dished portion results in limiting the life of the diaphragm. In other embodiments, the entire diaphragm is dished and maintained on the electrical contact member by means of a thin flexible membrane which also provides a seal for the switch. However, the use of a membrane to retain the diaphragms in their respective seats limits the positioning of the stationary center contact to the low pressure side of the diaphragm (to close a circuit upon pressure increase). That is, the membrane would preclude the use of a fixed contact on the high pressure side of this diaphragm (to open a circuit upon selected pressure increase).

A further improvement in the prior art is set forth in application Ser. No. 169,799, filed Mar. 18, 1988, by forming the entire surface of the diaphragm into a dished configuration with the center of the diaphragm having a pressure versus deflection relationship such that for increasing pressure from 0 psig up to and beyond a plateau having a range of deflections between d1 and d2, the diaphragm has a relatively stiff effective spring rate with the center deflecting between d1 and d2 at essentially the same pressure level, the diaphragm also having a relatively narrow differential between the pressure at which the center of the diaphragm deflects between d1 and d2 on increasing pressure and the pressure at which it deflects between d2 and d1 on decreasing pressure.

While the above noted prior art has demonstrated continual improvement in the required properties, it is the continual intent of the industry to further improve such switches. In addition, it has been found that in certain applications, such as in engine control modules (ECMs), certain ones of the switches must be normally open whereas others must be normally closed. This requirement has caused the need of an inventory of at least two different switches It is therefore apparent that a single switch which can perform either directly or with minimum alteration as both a normally open and a normally closed switch would greatly reduce the inventory requirement. This problem is solved in accordance with the present invention.

SUMMARY OF THE INVENTION

Briefly, in accordance with the present invention, there is provided an insert molded lead frame assembly or a printed wiring board (it being understood that whenever a printed wiring board is mentioned herein a molded lead frame assembly can be substituted therefor) having plural pressure responsive switches thereon, each switch comprising, according to one embodiment, upper and lower contact members with a snap acting member and an electrically conductive member which is insulated from the upper and lower contact members sandwiched between the upper and lower contact members. The upper contact member includes an electrically insulating body with a hollow center portion which is molded around an electrically conductive member having a contact portion in the hollow center portion, the conductor extending externally of the insulating body. The lower contact member also includes an electrically insulating body with a hollow center portion which is molded around an electrically conductive member having a contact portion in the hollow center portion, the conductor extending externally of the insulating body. The snap acting member is in constant contact with the sandwiched electrically conductive member and normally in contact with the contact of the upper contact member. When a pressure is applied which is sufficient to cause the snap acting member to snap into its second stable state, the contact thereof with the contact in the upper contact member is broken and contact is made with the contact in the lower contact member.

The switch can be provided as normally closed by removing the portion of the conductor on the lower contact member which extends externally of said member. The switch can be provided as normally open by removing the portion of the conductor on the upper contact member which extends externally of said member.

In accordance with another embodiment of the invention, a pressure responsive switch is provided for operation in conjunction with a printed circuit board having an electrically conductive back plate. The switch comprises an electrically conductive contact member fixed to the board and having a contact bump and an air conducting passageway. A pressure responsive flexible electrically conductive contact member is provided which normally contacts the bump and is responsive to a predetermined pressure thereon to move out of contact with the bump. An electrically conductive support for the flexible contact member is secured to the board within the fixed contact member.

DESCRIPTION OF THE PREFERRED EMBODIMENTS

Figure 1:
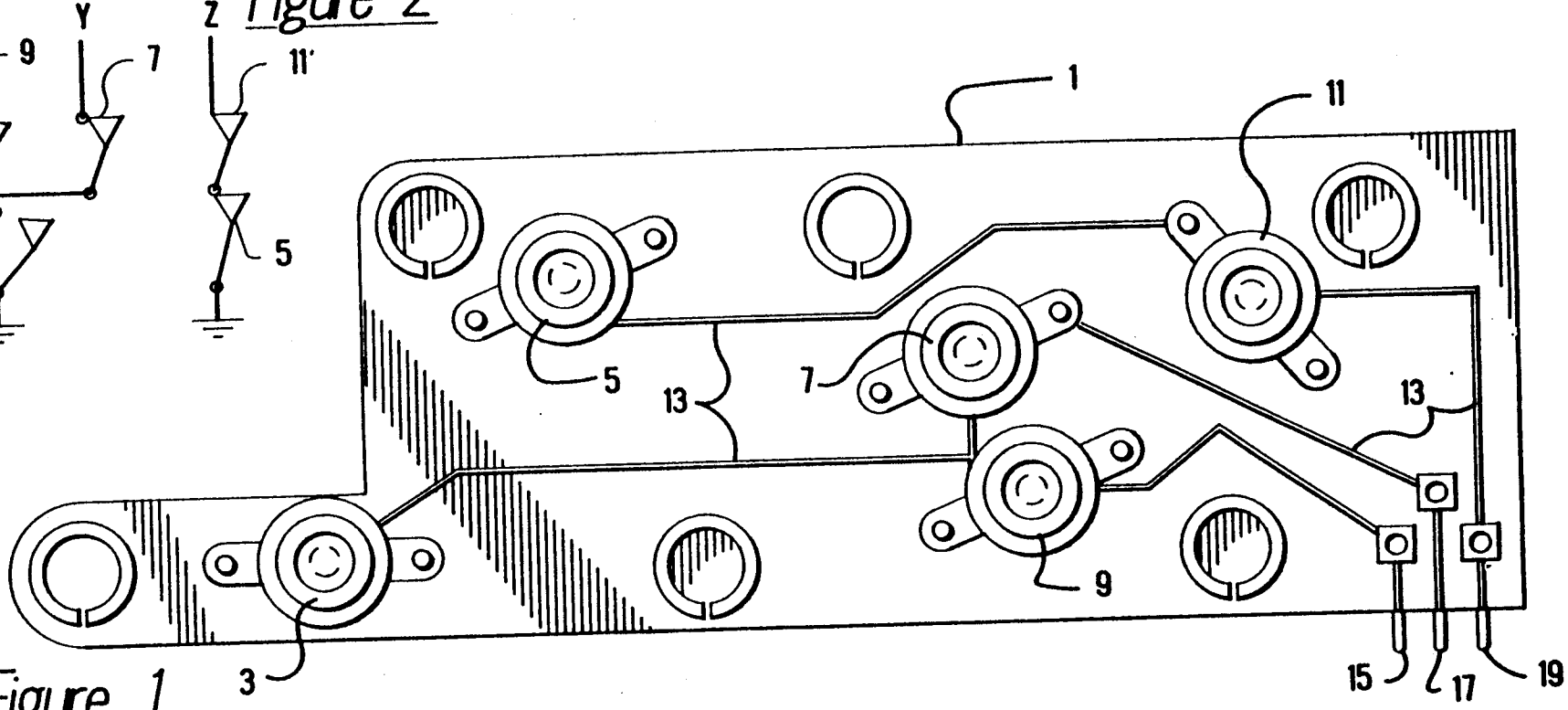
FIG. 1 is a top view of a printed wiring board containing five pressure responsive electrical switches mounted thereon in accordance with the present invention.

Referring first to FIG. 1, there is shown a top view of a printed wiring board 1 which i formed of electrically insulating material a in a well known manner and has pressure responsive electrical switches mounted thereon. Five such electrical switches 3, 5, 7, 9 and 11 are shown.

The switches are each connected to electrical conductors 13 on the board 1 via pads on the board (not shown) for contacting terminals of the switches (to be discussed hereinbelow), these conductors interconnecting with plural ones of the switches and/or with terminals 15, 17 and 19 denoted as X, Y and Z, respectively (corresponding to the X, Y and Z terminals in FIG. 2), at the edge of the board for interface with external devices. The board 1 is secured to a hYdraulic manifold, for example, a valve body or other appropriate support (not shown), whereby the upper surface of each of the pressure responsive switches 3 through 11 abuts and is in hermetic sealing relationship with a variable pressure source in the valve body whereby such pressure causes each switch to operate in accordance with the degree of pressure then present at each switch as will be explained in greater detail hereinbelow.

Figure 2:
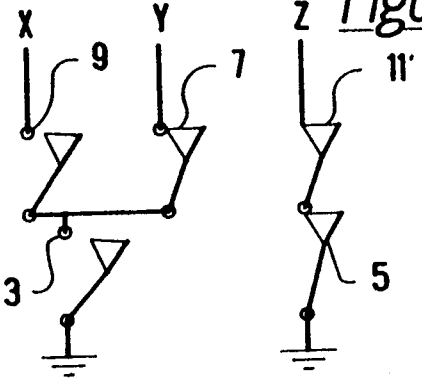
FIG. 2 is a circuit diagram showing the arrangement of the switches of FIG. 1.

Referring now to FIG. 2, there is shown the electrical arrangement of the switches 3 through 11. As can be seen, the switches 3 and 9 are normally open and the switches 5, 7 and 11 are normally closed. The switches are arranged whereby circuit paths on the board 1 connect both switches 7 and 9 to switch 3 and switch 11 is connected to switch 5. A reference voltage output is provided on terminal 15 when switches 3 and 9 are closed, a reference voltage output is provided on terminal 17 when switches 3 and 7 are closed and a reference voltage output is provided on terminal 19 when switches 5 and 11 are closed. A computer or the like which is coupled to the terminals 15, 17 and 19 can provided predetermined information from the sensed signals on these terminals. For example, if the arrangement as shown in FIG. 1 is utilized to sense pressures at five locations in an automobile transmission, this being standard in the art, the particular gear in which the transmission is operating (i.e. drive, second, third, fourth, reverse) can immediately be determined and appropriate action, if required, can be instituted therefrom.

Figure 1A:
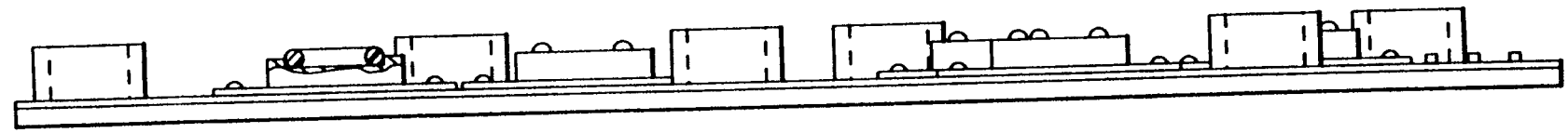
FIG. 1*a* is a front view of the FIG. 1 board.
Figure 3:
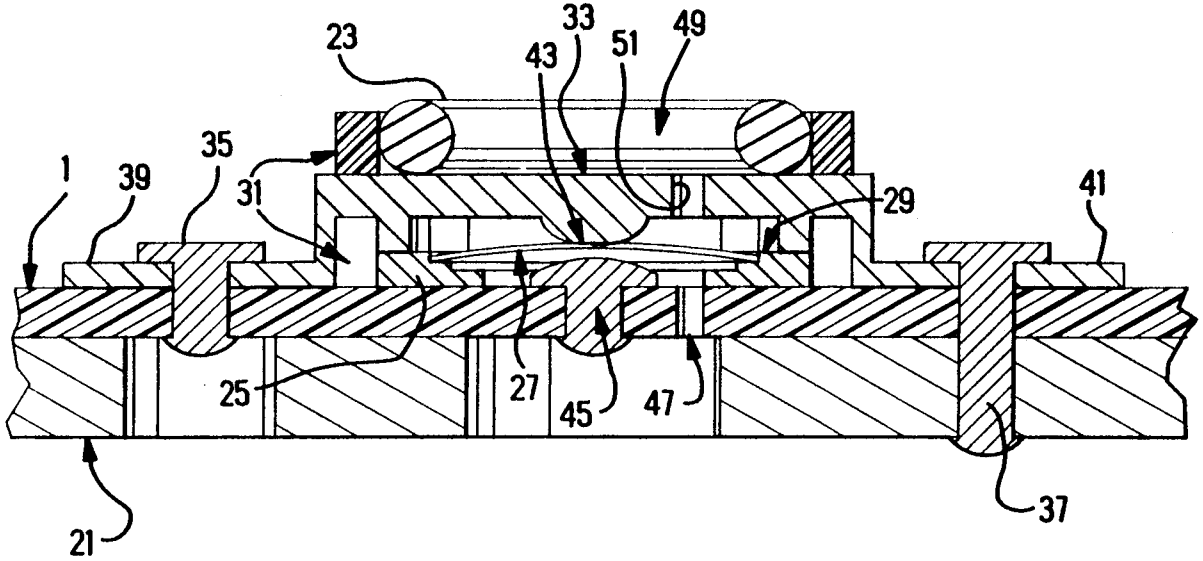
FIG. 3 is a cross sectional view of a pressure responsive electrical switch in accordance with a first embodiment of the present invention.
Figure 3A:
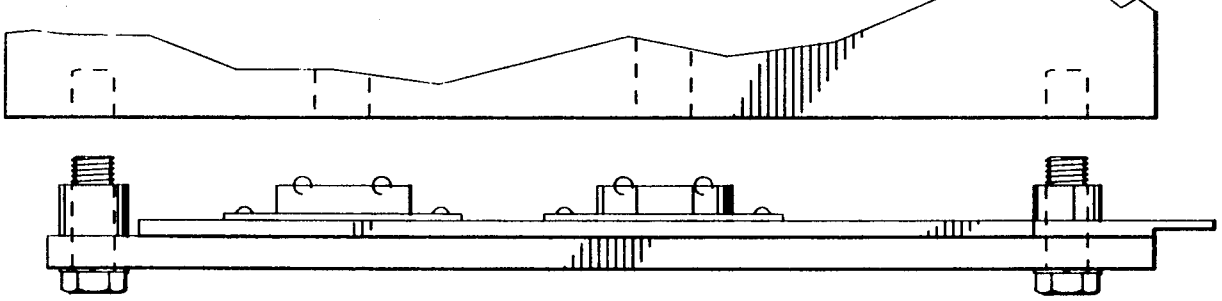
FIG. 3*a* is a front view of a board which includes the FIG. 3 switch assembly.

Referring now to FIG. 3, there is shown a first embodiment of a switch in accordance with the present invention. The switch is secured to the electrically insulating circuit board 1, the latter having an electrically conductive back plate 21. The switch itself is one of the switches 3 through 11 as depicted in FIGS. 1 and 1*a*. The disc seat 25 is disposed on a pad (not shown) of the circuit board 1, the disc seat having a disc 27 which is held in place by a diaphragm 29 with a hole at its center. It should be understood that the diaphragm 29 can be omitted, the diaphragm being used,,as an insulating washer between disc seat 25 and conductive member 33 wherein the hole in the diaphragm can be the diameter of the normally closed contact bump 43 depending from member 33 of the switch the insulator 31 is placed around the disc seat, the diaphragm 29 is placed over the disc seat and the conductive member 33 is placed over the disc seat insulator and diaphragm. Rivet 35 or rivet 37 attaches the wing 39 or the wing 41 of conductive member 33 to the circuit board depending upon the nature of the switch. That is rivet 35 can be attached through wing 39 and a pad only, providing a connection to a pad or rivet 37 can be attached to the back plate 21 to provide a ground connection to wing 41, as required, through the rivets. Normally, only one of the rivets 35 and 37 and one of the wings 39 and 41 will be used at one time. The metal back plate 21 is also utilized to prevent excessive deflection of the circuit board when pressure is applied. Normally closed contact bump 43 engages the disc 27 through the hole in the diaphragm 29. In addition, a normally open contact rivet 45 is secured in the circuit board 1 below and out of normal engagement with the diaphragm 29. A bleed hole 47 is provided in the circuit board 1 in the cavity formed by the diaphragm 29 and housing the upper portion of the contact rivet 45 to permit the escape of air or other fluid therethrough when the diaphragm is depressed.

When used as a normally closed switch, the current flow is from a pad under the normally closed contact wing 39, through the conductive member 33 to the contact bump 43 which is in engagement with the disc 27. The current then flows to the center of the disc 27 and through the disc to the disc seat 25 and pad thereunder to the remainder of the circuit. The normally open contact rivet 45 is either omitted in this version or unconnected to external circuitry.

When used as a normally open switch, the normally open contact rivet 45 is in place and connected to external circuitry. Current flows through the paths on the circuit board 1 and pad thereon to the disc seat 25 and then to the disc 27. From the disc the current flows to the normally open contact rivet 45 and then to the circuitry to which the contact 45 is connected. In this embodiment, the contact bump 43 would preferably be removed or adjusted to avoid contact between the conductive member 33 and the disc 27.

The switch of FIG. 3 can be provided as a, single pole double throw switch by using both the normally closed contact bump 43 and the normally open contact rivet 45. The disk seat 25 is the common. The normally open contact will close when a sufficiently high pressure is applied to the diaphragm 29.

An external gasket 23, shown in the form of an "O"-ring, which contacts the valve body and provides the liquid tight seal discussed hereinabove is disposed in the recess 49 formed by the insulator an the conductive member 33 when the assembly is bolted to the valve body, the "O"-ring being compressed and forming a seal. The conductive member 33 includes an aperture 51 therethrough communicating with the diaphragm 29 to permit pressure in the recess 49 to impinge against the diaphragm. Pressure provided against the diaphragm 29 via the recess 49 forces the diaphragm against the disk 27 and moves the disk out of engagement with the contact bump 43 or into engagement with the contact rivet 45 to open the normally closed circuit and/or close the normally open circuit.

It should be understood that the O-ring 23 described above and elsewhere herein can be replaced by a gasket having other geometries, such as, for example, a rectangular cross section. The use of a gasket with rectangular cross section adds greater compressive force to the switch to help in sealing and to provide a positive seat against the backplate.

It can be seen that the switch of FIG. 3 provides versatility because the circuit layout can be easily changed to accommodate additional switches or changes in the location of the switches.

Figure 4:
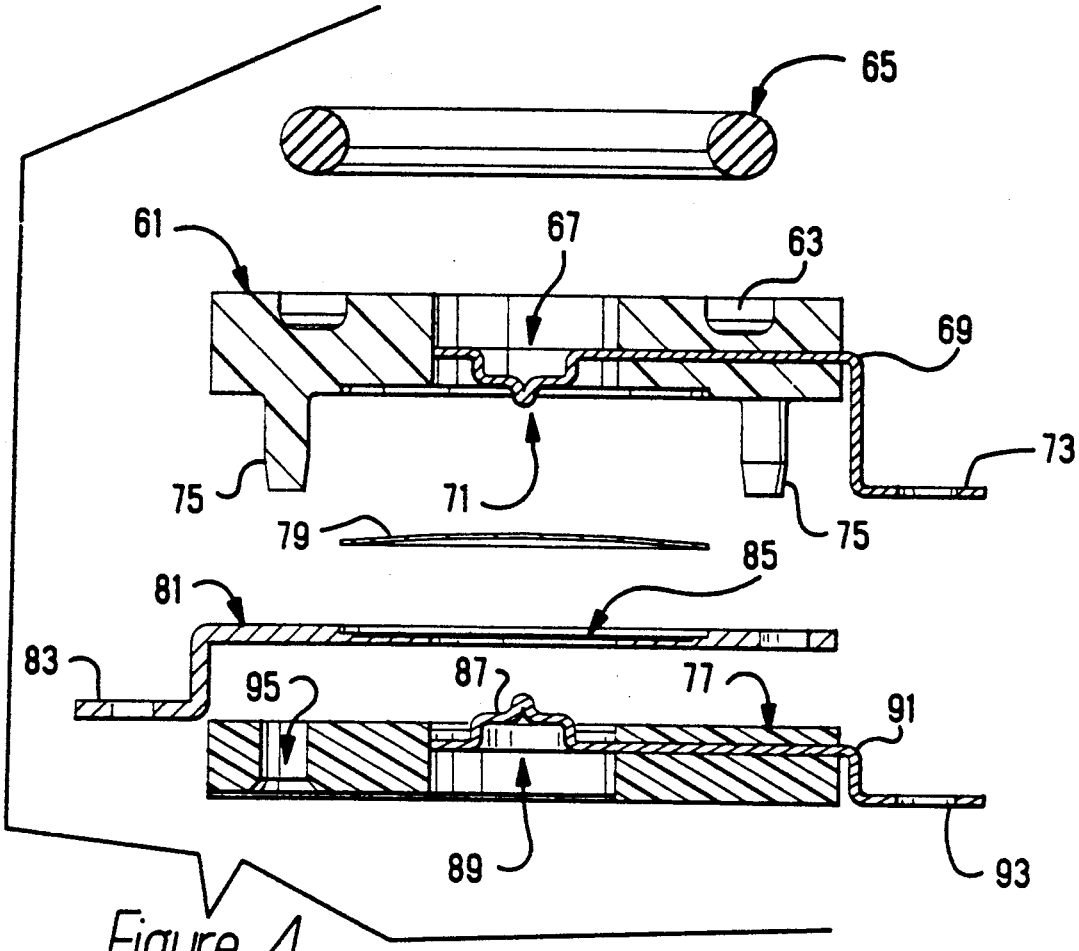
FIG. 4 is an exploded cross sectional view of a pressure responsive electrical switch in accordance with the second embodiment of the present invention.
Figure 5:
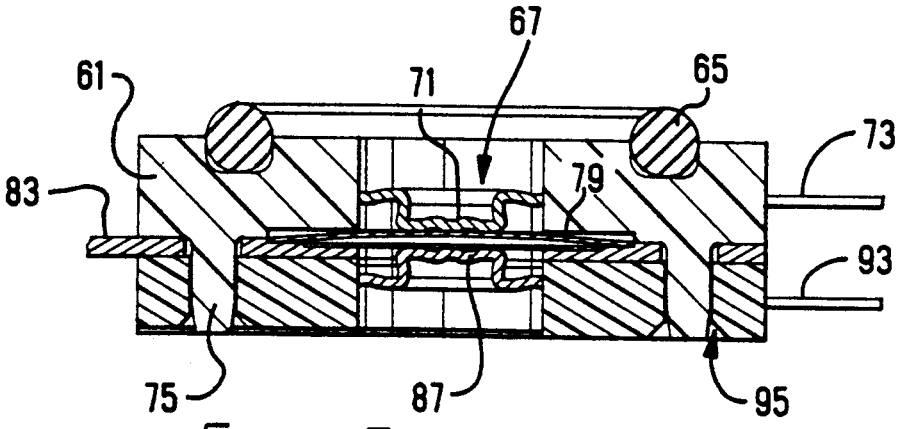
FIG. 5 is an assembled view of the embodiment of FIG. 4.

Referring now to FIGS. 4 and 5, there is shown a second embodiment of a pressure responsive switch in accordance with the invention. The switch includes an upper housing 61 having an annular groove 63 for receiving an "O"-ring or gasket of other geometrical shape 65 therein and a hollow center region 67. The groove 63 preferably has the same cross sectional shape as the gasket 65. The housing 61 is formed of electrically nonconductive plastic and includes a brass conductor 69 molded therein, the conductor having a depressed region disposed in the center region 67 to form a contact 71 and a terminal wing portion 73 extending from the contact for connection to a circuit board 1. The upper housing also includes depending legs 75 for mating with a lower housing 77. An electrically conductive stainless steel snap action disc 79 is disposed beneath the contact 71 and in contact therewith. Disposed below the disc is a disc seat 81 in the form of an electrically conductive brass member having a terminal wing portion 83 for connection to the board 1, the disc seat also having an apertured center portion 85 for allowing the disc 79 to travel therethrough to contact the contact member 87 when in the snapped position. The lower housing 77 has a hollow center region 89 for receiving the contact 87. The lower contact 77 is formed of electrically non-conductive plastic and includes a brass conductor 91 molded therein, the conductor having the contact 87 as a portion thereof and a terminal wing portion 93 extending from the contact for connection to the circuit board 1. The lower contact also includes grooves 95 for receiving the legs 75 therein whereby the disc 79 and the disc seat 81 can be secured between the upper and lower contacts.

The elements of the switch of FIGS. 4 and 5 are designed for automatic assembly as a normally open or a normally closed switch as will be explained hereinbelow.

For a normally open pressure responsive switch, the wing 73 is not connected and the switch member stacked and secured by placing the members in the arrangement shown in FIGS. 4 and 5 and forcing the legs 75 of the upper contact into the grooves 95 of the lower contact. The circuit path is then from the circuit board to the disc seat 81 and then to the disc 79. Upon increase in pressure on the disc 79, the disc will snap to the lower position and contact the contact member 87, thereby completing the circuit to the wing 93 and then to the lead frame to complete the circuit.

For a normally closed pressure responsive switch, the wing 93 from the brass conductor 91 is not connected and the switch elements are assembled in the same manner as for the normally open arrangement. The circuit path is then from the circuit board to the disc seat 81 via wing 83 and then through the disc 79 to the brass insert 69 and then via wing 73 to the circuit board. Upon increasing pressure the disc 79 will snap to the lower position and travel out of contact with the contact 71 of the conductor 69 to open the circuit.

The switch components are held together by three plastic pins or legs 75 which extend from the bottom side of the upper contact 61 into the grooves 95 in the lower contact 77. The disc and disc seat are "sandwiched" between the upper and lower contacts 61 and 77. The legs 75 are secured in the grooves 95 by conventional means, such as by heat staking.

During the assembly of the switch, the upper contact 71 or lower contact 87 are adjusted relative to the location of the disc 79 to assure that the electrical contacts are in the proper position relative to the characteristic disc curve. The calibration of each switch assures a change in electrical continuity at a given operating pressure.

Once the switches are calibrated and assembly completed, the modular switch is function tested as a complete switch assembly. This design approach is unique since the pressure switches are independent of the method used to connect groups of switches in series/-parallel combinations. The modular, discrete switch can then be used in various low profile pressure switch (LPPS) application, but not be an integral component of any one particular LPPS design.

Figure 6:
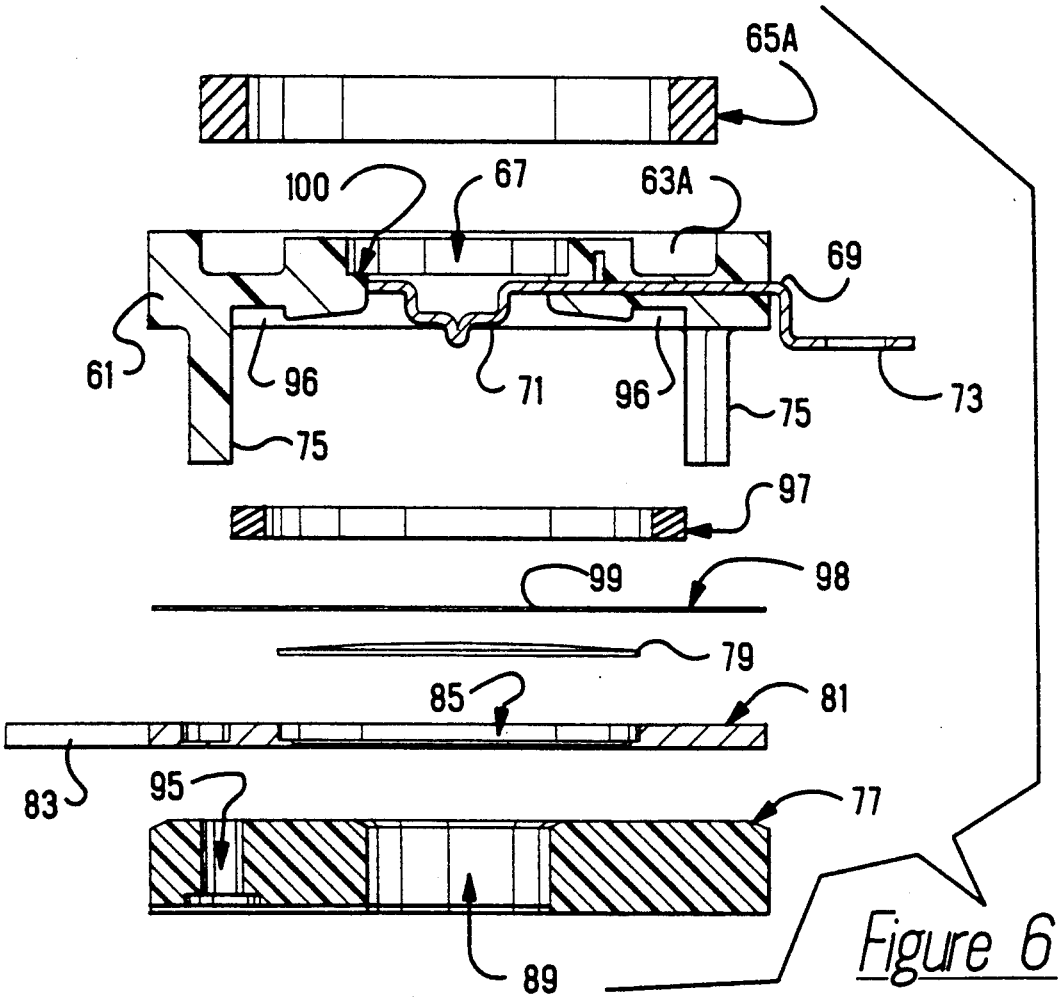
FIG. 6 is an exploded view of a pressure responsive switch in accordance with a third embodiment of the invention in the normally closed state.

As a further embodiment, as shown in FIG. 6 for a normally closed switch, wherein all like reference numbers refer to the same or similar parts as in the switch of FIGS. 4 and 5, the switch is modified to replace the O-ring 65 with an elastomer gasket 65A of rectangular cross section seated in the groove 63A. In addition, an annular internal elastomer gasket 97 of rectangular cross section is positioned in an annular groove 96 formed in the lower portion of the upper housing 61 surrounding the contact 71. A Kapton gasket 98 with the center region 99 thereof removed in the region over the contact 71 or 87 is positioned over the internal gasket 97 with the disc 79 contacting the Kapton gasket. The remaining structure is as shown in FIGS. 4 and 5 except that the contact and wing are not provided in the lower housing 77. A filter seat portion 100 is provided in the hollow center region 67 to accommodate, if desired, a filter 101 to prevent large contaminants from reaching the switching area.

Figure 7:
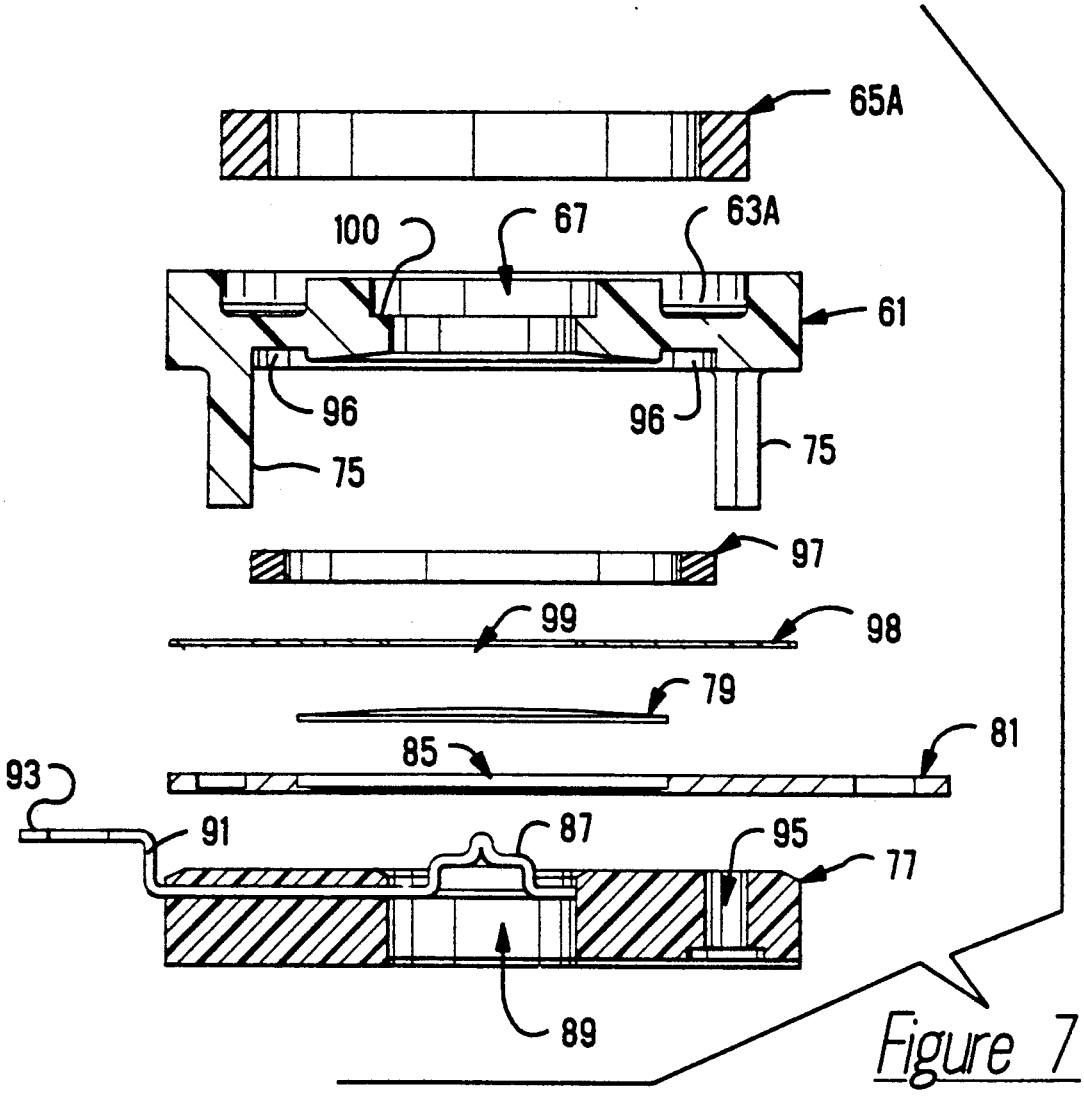
FIG. 7 is an exploded view of a pressure responsive switch as in FIG. 6 in the normally open state.

The switch of FIG. 6 is constructed as a normally open switch as shown in FIG. 7, wherein all like reference numbers refer to the same or similar parts as in the switch of FIGS. 4, 5 and 6, the switch being modified as in the FIG. 6 switch to replace the O-ring 65 with an elastomer gasket 65A of rectangular cross section seated in the groove 63A. Annular internal elastomer gasket 97 of rectangular cross section is positioned in an annular groove 96 formed in the lower portion of the upper housing 61 surrounding the contact 87 in the lower housing 77. A Kapton gasket 98 with the center region 99 thereof removed in the region over the contact 87 is positioned over the internal gasket 97 with the disc 79 contacting the Kapton gasket. The remaining structure is as shown in FIGS. 3 and 5 except that the contact and wing are not provided in the upper housing 61. In this embodiment, the contact 71 will not be molded into the upper housing 61 initially. A filter seat portion 100 is provided in the hollow center region 67 accomodate a filter, if desired, to to prevent large contaminants from reaching the switching area.

Figure 8A:
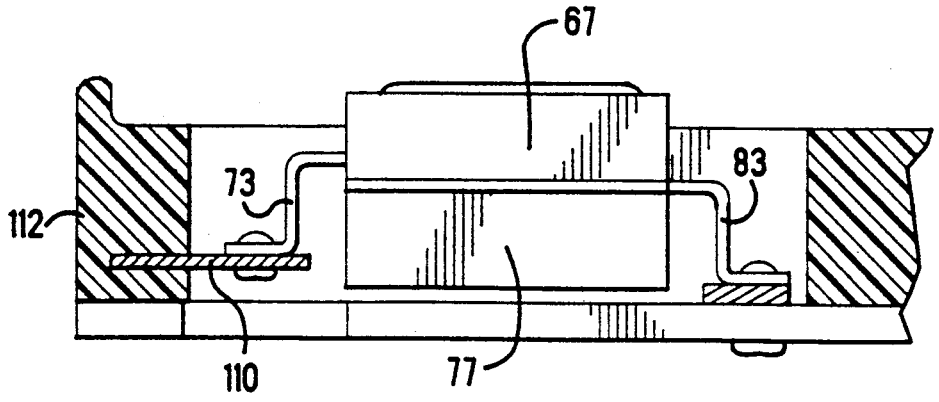
FIG. 8*a* is a cross sectional view of a portion of the FIG. 8 assembly showing a switch mounted thereon.
Figures 8, 8B:
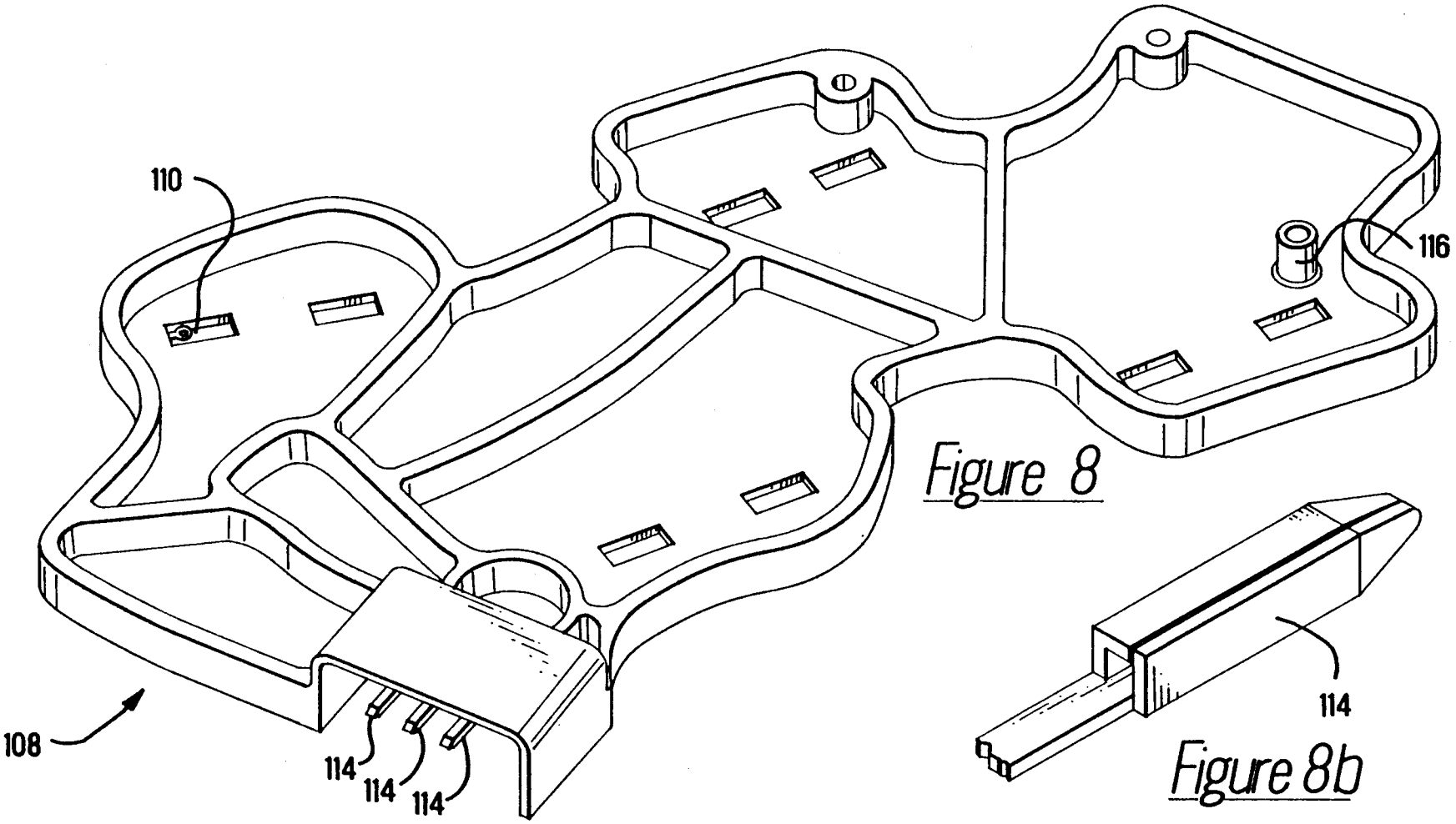
FIG. 8 is a perspective of a lead frame insulator assembly made in accordance with the invention.
FIG. 8*b* is a perspective view of a terminal pin formed integrally with the lead frame.

It should be understood that, whereas a printed wiring board is discussed hereinabove, an insert molded lead frame assembly as shown in FIGS. 8 and **8*a* can be substituted therefor. The lead frame assembly 108 is used to improve the integrity of the riveted functions to the electrical circuits. As seen in FIG. 8*a* this assembly is made of a metal stamped circuit 110 encapsulated in a non-conductive plastic 112. This approach also eliminates the rivets at the terminal pin—to—circuit function. Instead, the pins, as shown at 114 in FIG. 8, are formed from the circuit stamping. Further, an optional feature is an alignment pin 116** molded from the same plastic, the purpose of which is to simplify mounting in the application. These are cylindrical plastic features which allow for securing the assembly to the backplate by heat staking or similar procedures.

Though the invention has been described with respect to specific preferred embodiments thereof, many variations and modifications will immediately become apparent to those skilled in the art. It is therefore the intentiсn that the appended claims be interpreted as broadly as possible in view of the prior art to include all such variations and modifications.

What is claimed is:

1. A pressure responsive switch, which comprises:

(a) an upper contact assembly comprising a first electrically insulating body having a first hollow central region and a first electrically conducting member having a depending contact ember extending into said first hollow central region;

(b) a lower contact assembly comprising a second electrically insulating body having a second hollow central region and a second electrically conducting member having an upwardly extending contact member extending into said second hollow region; and (c) a pressure responsive snap acting member responsive to predetermined pressure thereagainst to switch from one of an upwardly extending and a downwardly extending condition to the other of said conditions and a third electrically conducting member, said snap acting member and said third member being sandwiched between said upper and lower contact assemblies, said third member including an aperture with at least one of said contact members received therein and electrically insulated from said other contact member, said snap acting member being positioned over said aperture in said third member and between said depending and upwardly extending contact members, at least one of said first and second electrically conducting members extending internally and externally of its respective insulating body.

2. A switch as set forth in claim 1 wherein said depending contact member is normally in engagement with said snap acting member and said upwardly extending contact member is normally out of engagement with said snap acting member.

3. A switch as set forth in claim 1 wherein said upper contact assembly further includes a recess and an o-ring disposed in said recess and extending out of said recess.

4. A switch as set forth in claim 2 wherein said upper contact assembly further includes a recess and an o-ring disposed in said recess and extending out of said recess.

5. A switch as set forth in claim 1 wherein one of said upper and lower contact assemblies includes outwardly extending legs and the other of said upper and lower contact assemblies includes grooves for fixedly receiving said legs therein.

6. A switch as set forth in claim 2 wherein one of said upper and lower contact assemblies includes outwardly extending legs and the other of said upper and lower contact assemblies includes grooves for fixedly receiving said legs therein.

7. A switch as set forth in claim 3 wherein one of said upper and lower contact assemblies includes outwardly extending legs and the other of said upper and lower contact assemblies includes grooves for fixedly receiving said legs therein.

8. A switch as set forth in claim 4 wherein one of said upper and lower contact assemblies includes outwardly extending legs and the other of said upper and lower contact assemblies includes grooves for fixedly receiving said legs therein.

9. A pressure responsive switch with a printed circuit board having an electrically conductive back plate, which comprises:

(a) a fixed electrically conductive contact member fixed to said board and having a contact bump thereon and an air conducting passageway therethrough;

(b) a pressure responsive flexible electrically conductive contact member normally contacting said bump and responsive to a predetermined pressure to move out of contact with said bump; and (c) an electrically conductive support which supports said flexible contact member and is secured to said board within said fixed contact member.

10. A switch as set forth in claim 9 wherein said fixed contact member includes a recess, said air conducting passageway exiting within said recess, and an o-ring disposed in said recess and encircling said exit of said passageway.

11. A switch as set forth in claim 9 further including a contact rivet secured to said board on the side of said flexible member opposite said bump said flexible member being responsive to a predetermined pressure in said passageway to contact said contact rivet.

12. A switch as set forth in claim 10 further including a contact rivet secured to said board on the side of said flexible member opposite said bump said flexible member being responsive to a predetermined pressure in said passageway to contact said contact rivet.

13. A pressure responsive switch, which comprises:

(a) an upper assembly comprising a first electrically insulating body having a first hollow central region;

(b) a lower assembly comprising a second electrically insulating body having a second hollow central region;

(c) a pressure responsive snap acting member responsive to predetermined pressure there against to switch from one of an upwardly extending and a downwardly extending condition to the other of said conditions and an electrically conducting member, said snap acting member and said electrically conducting member being sandwiched between said upper and lower assemblies, (d) another electrically conducting member having a contact member received in the lower assembly, the contact member extending into a respective hollow central region and having a portion extending externally of its respective insulating body, said contact member in engagement with said snap action member when said snap acting member is in one of its said conditions and out of engagement therewith when said snap acting member is in the other of said condition; wherein the said another electrically conducting member is received in the lower assembly and the sandwiched electrically conducting member includes an aperture with said contact member received therein and said sandwiched electrically conducting member being electrically insulated from said contact member, said snap acting member being positioned over said aperture in said sandwiched electrically conducting member adjacent said contact member.

14. A switch as set forth in claim 13 wherein one of said assemblies includes outwardly extending legs and the other of said upper and lower assemblies includes grooves for fixedly receiving said legs therein.

* * * * *